US005997130A

United States Patent [19]

Bolash et al.

[11] Patent Number: 5,997,130

[45] Date of Patent: Dec. 7, 1999

[54] ASYMMETRICAL ACCELERATION RAMP AREA AND METHOD FOR PRINT CARTRIDGE CARRIER OF INK JET PRINTER

[75] Inventors: John Philip Bolash; Edmund Hulin James, III, both of Lexington, Ky.

[73] Assignee: Lexmark International, Inc., Lexington, Ky.

[21] Appl. No.: 08/854,609

[22] Filed: May 12, 1997

[51] Int. Cl.[6] ..... B41J 23/00

[52] U.S. Cl. ..... 347/37

[58] Field of Search ..... 342/32; 400/279, 400/220, 222, 223, 903, 39, 709, 705, 705.1

[56] References Cited

U.S. PATENT DOCUMENTS

| | | | |
|---|---|---|---|
| 4,050,564 | 9/1977 | Carmichael et al. | 347/37 |
| 4,079,298 | 3/1978 | Prager | 347/37 |
| 4,203,678 | 5/1980 | Nordstrom et al. | 347/37 |
| 4,311,399 | 1/1982 | Wegryn et al. | 347/37 |
| 4,508,463 | 4/1985 | Wang et al. | 347/37 |
| 4,761,085 | 8/1988 | Angst et al. | 347/37 |
| 4,869,610 | 9/1989 | Nishizawa et al. | 347/37 |
| 4,948,279 | 8/1990 | Ikoma et al. | 347/37 |
| 5,033,889 | 7/1991 | Carney | 347/37 |
| 5,189,436 | 2/1993 | Yoshikawa | 347/37 |
| 5,207,520 | 5/1993 | Tanaka | 347/37 |
| 5,245,359 | 9/1993 | Ito et al. | 347/37 |
| 5,291,824 | 3/1994 | Matsumoto et al. | 347/37 |
| 5,527,121 | 6/1996 | Santon | 400/323 |
| 5,547,295 | 8/1996 | Kanemitsu | 347/37 |
| 5,561,449 | 10/1996 | Raskin et al. | 347/37 |

*Primary Examiner*—N. Le
*Assistant Examiner*—Thien Tran
*Attorney, Agent, or Firm*—John J. McArdle

[57] ABSTRACT

Apparatus and a method for printer size reduction moves a carrier with print element through a carrier displacement field containing two acceleration ramp area subportions on opposite sides of a print line subportion. The acceleration ramp subportions are of different lengths. A first subportion permits acceleration of the print element to substantially all of a first lower print element speed. The second subportion permits acceleration of the print element to less than substantially all of a second higher print element speed. The overall field size is reduced, but functions effectively for uni-directional printing at the first (letter mode) speed and bi-directional printing at the second (draft mode) speed.

20 Claims, 3 Drawing Sheets

ASYMMETRICAL ACCELERATION RAMP AREA AND METHOD FOR PRINT CARTRIDGE CARRIER OF INK JET PRINTER

BACKGROUND OF THE INVENTION

Field of the Invention

The present invention relates to apparatus and a method for use in printing, specifically for use in the area of printing as implemented in the computing field. More specifically, the present invention relates to apparatus and a method for increasing and decreasing the speed of a print cartridge carrier, in conjunction with the control of the print quality, along an acceleration ramp area having a more optimum design of shorter length. The present invention is particularly beneficial for use within an ink jet printer, but may be incorporated with effect in other serial print systems as well.

Background Developments

Conventional ink jet printers employ a carrier to displace ink-containing print cartridges bi-directionally across a carrier displacement field. The carrier displacement field includes a print line portion (or simply "print line") through which the print cartridges travel to disperse ink, in a controlled manner, onto paper or other suitable media. The carrier displacement field also includes a non-print portion separate from and adjacent to the print line portion. The non-print portion typically comprises two equal-length subportions of the carrier displacement field with each of the two subportions being located adjacent to but on opposite sides of the print line portion of the carrier displacement field.

The non-print subportions of the displacement field are used to uniformly provide on both sides of the print line space for the carrier to acquire (at the start of its travel) and uniformly to lose (at the end of its travel) sufficient speed in accordance with a desired level of print quality as the print cartridge is moved back and forth across the media. In view of this purpose of the non-media subportions of the carrier field, that portion of the displacement field is referred to as the "acceleration ramp area." As one of ordinary skill in the art also would know, the carrier displacement field, at least for ink jet printers, typically also includes another portion, a maintenance station area, that typically is located at the outward-most end of the carrier displacement field and adjacent the outward-most side of one of the two subportions comprising the acceleration ramp area. A maintenance station located in the maintenance station area is used to clean and prepare the cartridge for dispersing ink.

In certain conventional printing systems, the two acceleration ramp area subportions are sized uniformly and with relatively great length to allow the carrier to accelerate to obtain full print speed before reaching the print line on both sides of the print line for all of the carrier's travel through the print line, and to support such carrier travel for the print mode with the highest characteristic speed. Specifically, sufficient acceleration ramp area for the carrier to achieve full operating speed for all of its travel through the print line is provided for printer function in the lower quality mode known as "draft mode."

In draft mode, the print cartridge disperses approximately half as much ink as it would be required to do in higher quality print modes such as "letter mode." Because the print cartridge is dispersing half as much ink in draft mode, it is useful to move the carrier through the print line at about twice the speed desired in letter mode. Without changing other operational characteristics such as acceleration rate (which change requires, among other things, use of a relatively larger power supply), obtaining that higher draft mode speed requires a relatively long acceleration ramp area of the kind conventionally provided. Unfortunately, however, longer ramps undesirably increase the size, cost and print quality of printing systems.

Other known printing systems take a different approach to acceleration ramp area sizing. Such systems address the cost/size versus print quality dilemma that is described above by uniformly reducing by a predetermined amount the length of the uniformly-sized non-print subportions of the acceleration ramp area. More specifically, the length of both acceleration ramp area subportions is modestly and uniformly reduced so the carrier reaches less than full draft mode print speed (i.e., less than, for example, 33 inches per second ("i.p.s.")) at the time the carrier reaches the print line and draft mode printing begins. The reduction in acceleration ramp area is an acknowledgment of the fact that ramp sizing in the earlier-described systems was done to prevent any degradation in print quality for a mode, which has as its very purpose allowing printing at lower quality. In view of the purpose of draft mode, ramp area sizing need not be controlled by the full draft mode speed.

In conventional systems, which have the size of both subportions of the acceleration ramp area uniformly reduced, both subportions support attaining something less than full speed for draft mode upon entering the print line, but fully support, at the start of and throughout the entire print line, attaining the slower speed required for high quality letter mode printing.

Illustratively, letter mode printing can be achieved with the carrier traveling at 15 i.p.s. through the print line, having been accelerated at 384 inches/s$^2$ (or "1.0 g") through the ramp area. An acceleration ramp area subportion of sufficient length to allow a carrier accelerating at 1.0 g to enter the print line at 15 i.p.s. may have, for example, a length of approximately 0.30 inches. On the other hand, the ramp area to support entry of the carrier into the print line at a full draft mode speed of, for example, 33 i.p.s. and accelerating at 1.0 g from rest would be approximately 1.42 inches long, which is a significantly greater length. However, using the shorter length required to support full letter mode speed still would permit the carrier, operating in draft mode, to achieve a speed significantly in excess of approximately 8.25 i.p.s. or 25% of the full draft mode speed of 33 i.p.s. upon print line entry. And any percentage of full speed in this 25% or greater range has been viewed as an acceptable speed for commencing draft mode printing.

Since conventional printing systems with uniformly shortened acceleration ramp area subportions begin draft mode printing at less than full speed, such systems typically also incorporate improved mechanisms or subsystems that enable adjustment of the dispersion of the ink from the print cartridge in accordance with actual cartridge speed (as opposed to the desired, but-not-yet-realized speed) of the accelerating print cartridge. Such apparatus and methods simply may involve the use of improved servo devices to more effectively regulate machine function during acceleration of the carrier on both ends of the displacement field.

While the above-described approach to acceleration ramp area sizing makes possible an advantageous reduction in the size and, thus, in the cost of printing systems without too great a loss in print quality, it should be recognized that the foregoing conventional shortened-ramp approach rigidly treats both ramp area subportions uniformly, without consideration of any differences in function of the two subportions. Specifically, the conventional approach ignores differences in how the two subportions typically are used to implement draft mode printing and letter mode (or other high quality mode) printing. Accordingly, any further size reductions that would have been made possible by considering such differences have not heretofore been considered or implemented.

The present invention relies upon such differences. Specifically, the fact that printing in quality modes, e.g., letter mode involves only un-idirectional acceleration of the carrier and uni-directional printing in the print line, while draft mode acceleration and printing operates bi-directionally, has been relied upon to reduce the total acceleration ramp area for a printing system even further, and, by so doing, further reduce overall system size and cost.

SUMMARY OF THE INVENTION

The present invention relies upon the fact that an acceptable length for an acceleration ramp area subportion that permits the carrier to reach full letter mode speed as the carrier enters the print line, is typically longer than the length for the carrier to reach an acceptable percentage of full draft mode speed as it enters the print line. Moreover, it relies upon the fact that, when letter mode is implemented uni-directionally, only one subportion needs the comparatively greater length to allow the carrier to accelerate to full letter mode speed for travel in and from the outset of travel through the print line.

In fact, it is known that carrier deceleration in letter mode also can be made to take place quickly (with the assistance of frictional and other electromechanical losses) and over less ramp area than required for letter mode acceleration. Accordingly, an acceleration ramp area subportion, which is not sized with comparatively greater length to support carrier acceleration for letter mode, also need not be so sized to accommodate carrier deceleration in letter mode. That subportion may be of shorter length in comparison with the other subportion that is used for uni-directional letter mode acceleration, and need be no longer than necessary to achieve the predetermined, acceptable percentage of full draft mode speed at which draft mode printing is permitted to begin.

Illustratively, the longer subportion for unidirectional letter mode acceleration may be 0.30 inches to allow acceleration at 1.0 g to a full letter mode speed of 15 i.p.s. upon entry into the print line. The other subportion may be only 0.09 inches, allowing acceleration of the carrier at 1.0 g to an acceptable 8.25 i.p.s. (25% of 33 i.p.s.) upon entry into the print line for bi-directional draft mode printing. The carrier speed through most of the print line, approaching from either subportion during draft mode operation, still would be at the full draft mode speed, e.g., at 33 i.p.s.

Accordingly, a printing system incorporating the present invention comprises a carrier for moving a print element through a print line portion of a carrier displacement field to place print images on recording media. The displacement field further comprises two acceleration ramp area subportions on opposite sides of the print line. The subportions are of different length, a first longer subportion permitting acceleration of the print element to a first print element carrier speed, and the second shorter subportion permitting acceleration of the print element to substantially less than all of a second print element carrier speed.

The first, longer subportion is operative to effect uni-directional travel of the print element through the entire print line at the first print element carrier speed. The second, shorter subportion is operative to support bi-directional travel of the print element through the print line at least at a predetermined percentage of the second print element carrier speed, which second print element carrier speed the print element eventually fully achieves for travel at the second print element carrier speed through a substantial portion of the print line upon approach from either subportion.

The first speed may correspond to a lower speed used to achieve high quality or letter mode printing. The second speed may correspond to a higher speed used to achieve draft mode printing.

A method corresponding to use of the apparatus of the present invention also is within the scope of the invention. The method comprises the steps of: accelerating a print element on a carrier, toward a print line portion of a carrier displacement field through a first relatively longer acceleration ramp area subportion to a first print element carrier speed for uni-directional travel through the print line in a first mode at the first print element carrier speed; accelerating the print element on the carrier, toward the print line, through the first relatively longer acceleration ramp area subportion and a second relatively shorter acceleration ramp area subportion, to less than a second print element carrier speed for bi-directional travel through the print line at the second print element carrier speed through a substantial length of the print line portion in a second mode; and printing images on recording media using the print element during travel of the print element through the print line portion.

BRIEF DESCRIPTION OF THE DRAWINGS

The above-described invention and its advantages, and the manner of practicing the same are hereafter described with reference to a preferred embodiment of the invention and relying for illustrative purposes on the accompanying drawings, wherein.

DETAILED DESCRIPTION OF THE PREFERRED EMBODIMENT

With the understanding that the details of constructing and operating a printing system that would incorporate the present invention are generally well known to those skilled in the art, a preferred embodiment of the present invention is now described with reference to the above-mentioned drawings.

Figure 1:
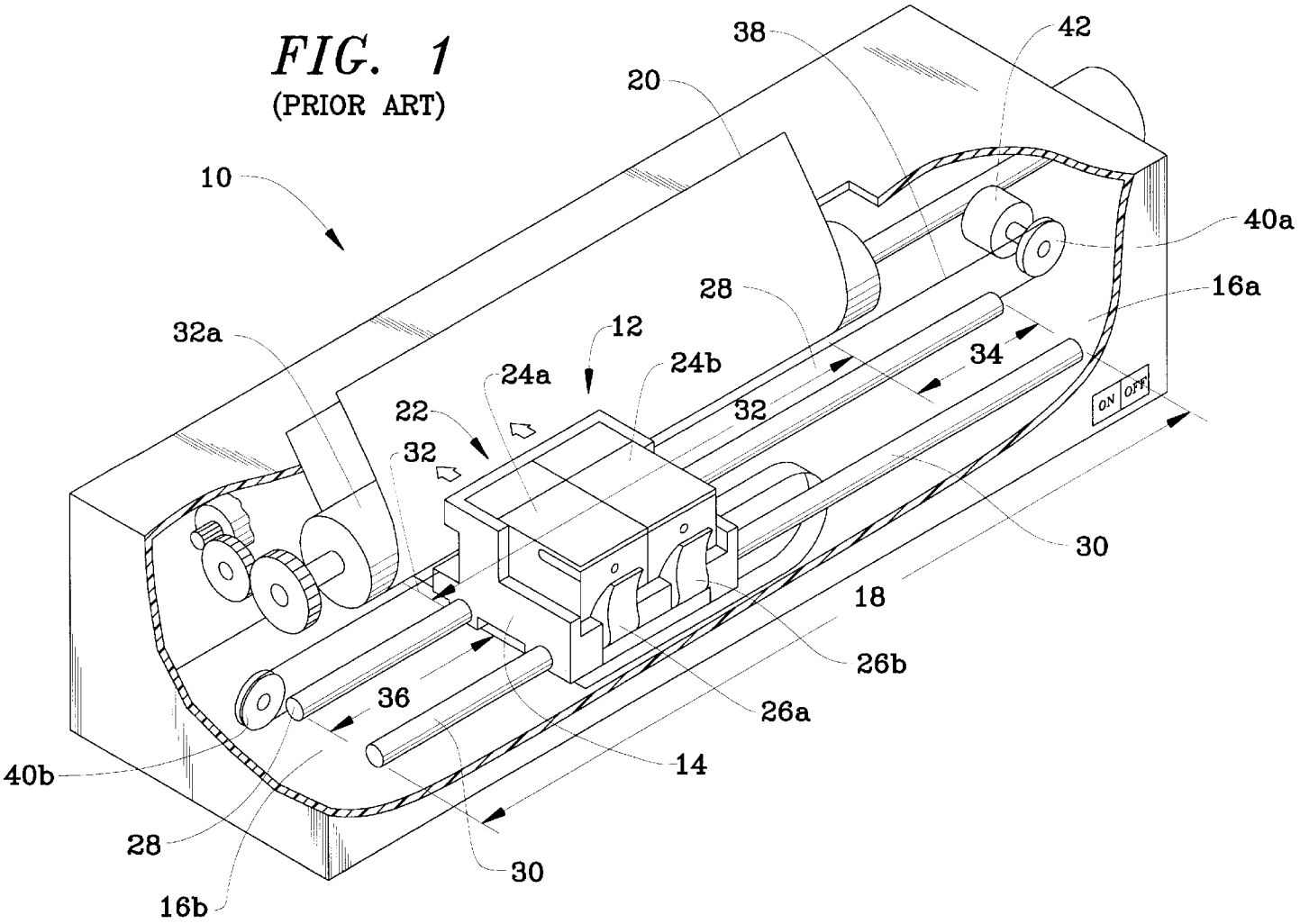
FIG. 1 (PRIOR ART)
FIG. 1 is a perspective view showing the construction of the area around the print element of a conventional (prior art) ink jet printing system.

Referring to FIG. 1 (prior art), a printing system 10, which for illustration purposes is an ink jet printer, is shown. Printer 10 includes an ink jet head assembly or print element 12 mounted in a carrier 14, which is arranged for bi-directional movement from one side 16A of a carrier displacement field 18 to the other side 16B and back again across a recording medium 20 for printing thereupon. (For purposes of the present depiction, the length of field 18 should be understood to comprise the entire internal area through which carrier 14 is laterally displaced between sides 16A and 16B.) Print element 12 includes drop nozzles 22 (not visible) through which ink is controllably dispersed onto recording medium 20.

Drop nozzles 22 are disposed in print cartridges 24A and 24B, that are secured to carrier 14 by keep members 26A and 26B, respectively. Cartridges 24A and 24B comprise main elements of print element 12. Carrier 14 is situated movably on shafts 28 and 30 for bi-directional movement through field 18. Field 18 includes a print line portion 32 through which ink may be dispersed onto recording medium 20. Print line portion 32 is defmed by most of the media-containing portion of the lateral length of roller 32A around which media 20 is wrapped for print feeding. Field 18 also includes a first acceleration ramp area subportion 34 and a second acceleration ramp area subportion 36, each located on a different side of print line portion 32 of field 18. In printer 10, subportions 34 and 36 are of equal length. Although subportions 34 and 36 are shown immediately adjacent print line portion 32, subportions 34 and 36 may be made to end slightly prior to print line 32 to achieve a "settle zone" of constant speed for carrier 14 prior to its entry into print line 32 during letter mode printing. Adjacent and outward of subportion 34 is a maintenance station portion of displacement field 18 (not shown) in which is contained a maintenance station for cleaning and preparing print cartridges 24A and 24B for continued use in printing. (As will be further apparent below, inclusion of a view of the maintenance station is unnecessary to fully describe the present invention.)

Carrier 14 is bi-directionally displaceable for travel along field 18 by means, for example, of a belt 38 secured to carrier 14 and operably connected to pulleys 40A and 40B, which are themselves operably connected, at one end, to a drive apparatus 42. (Connection of drive apparatus 42 is direct to pulley 40A and indirect to pulley 40B by means of belt 38.

Drive apparatus 42 of printer 10 is operable to accelerate carrier 14 through ramp area subportions 34 and 36 to attain fully a desired print mode speed for use in high quality printing modes, e.g., letter mode. Such speed would be attainable upon entry of carrier 14 into print line 32 from either direction because both ramp area subportions 34 and 36 are of a length permitting acceleration of carrier 14 to full letter mode speed upon print line entry.

Figure 2:
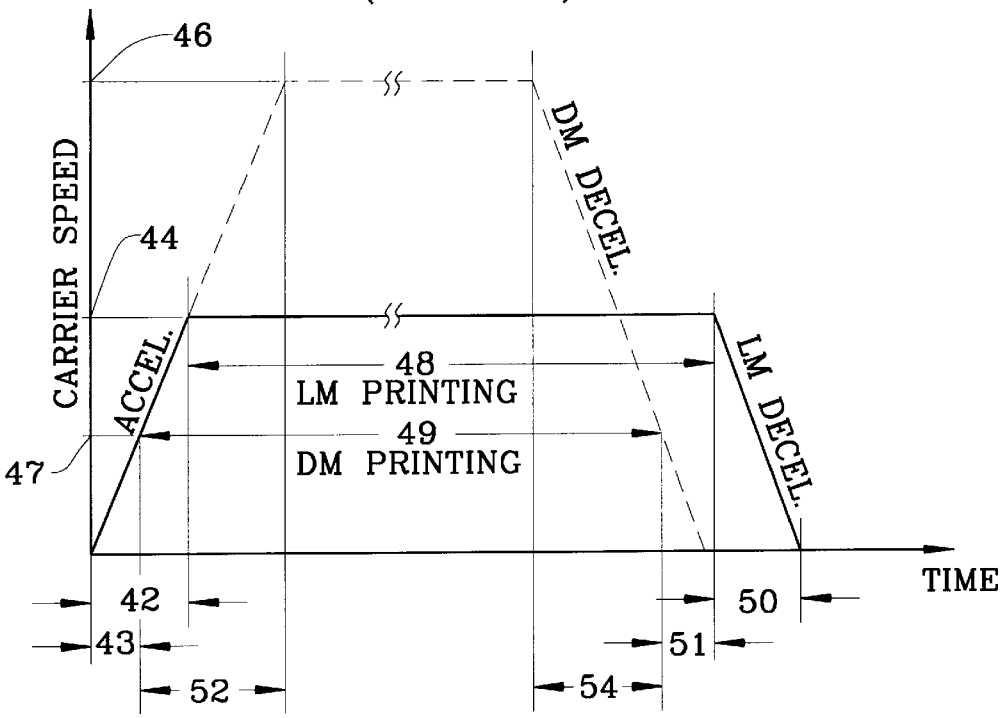
FIG. 2 (PRIOR ART)
FIG. 2 is a diagrammatic illustration of the operation of the print element in the carrier displacement field for a conventional (prior art) printing system.

As shown in FIG. 2, acceleration of carrier 14 to full letter mode speed is accomplished through a subportion travel time 42. Time 42 is associated with acceleration to print element carrier speed 44, which is approximately one half of a greater print element carrier speed 46 used in draft mode printing. In letter mode, speed 44 is fully attained prior to entry into and maintained throughout carrier travel time 48 associated with travel of carrier 14 at carrier speed 44 through print line 32. Deceleration of carrier 14 in letter mode takes place in a time 50 equivalent to time 42. As described, printer 10 would be capable of bi-directional operation in letter mode and in draft mode, due to the length of its acceleration ramp area subportions. Alternatively, it could be intended to operate printer 10 uni-directionally for letter mode printing, wherein letter mode acceleration during time 42 occurs only during travel of carrier 14 through acceleration ramp area subportion 34, and deceleration during time 50 occurs only during travel of carrier 14 through acceleration ramp area subportion 36.

Also as shown in FIG. 2, prior art printer 10 is operable to accelerate carrier 14 to speed 46 for draft mode printing. A print time 49 corresponds to travel of carrier 14 through print line 32 for draft mode printing. (Print line times 48 and 49 (and 149, below) are not shown proportionally.) Hence, it can be seen that, with printer 10, normal bi-directional draft mode printing is performed, i.e., begun at times while carrier 14 still is accelerating or decelerating (times 52/54). However, the length of subportions 34 and 36 supports adequate print line entry (departure) speed (25% of full desired speed, speed 47) for draft mode on both ends (achieved in times 43 and 51).

Figure 3:
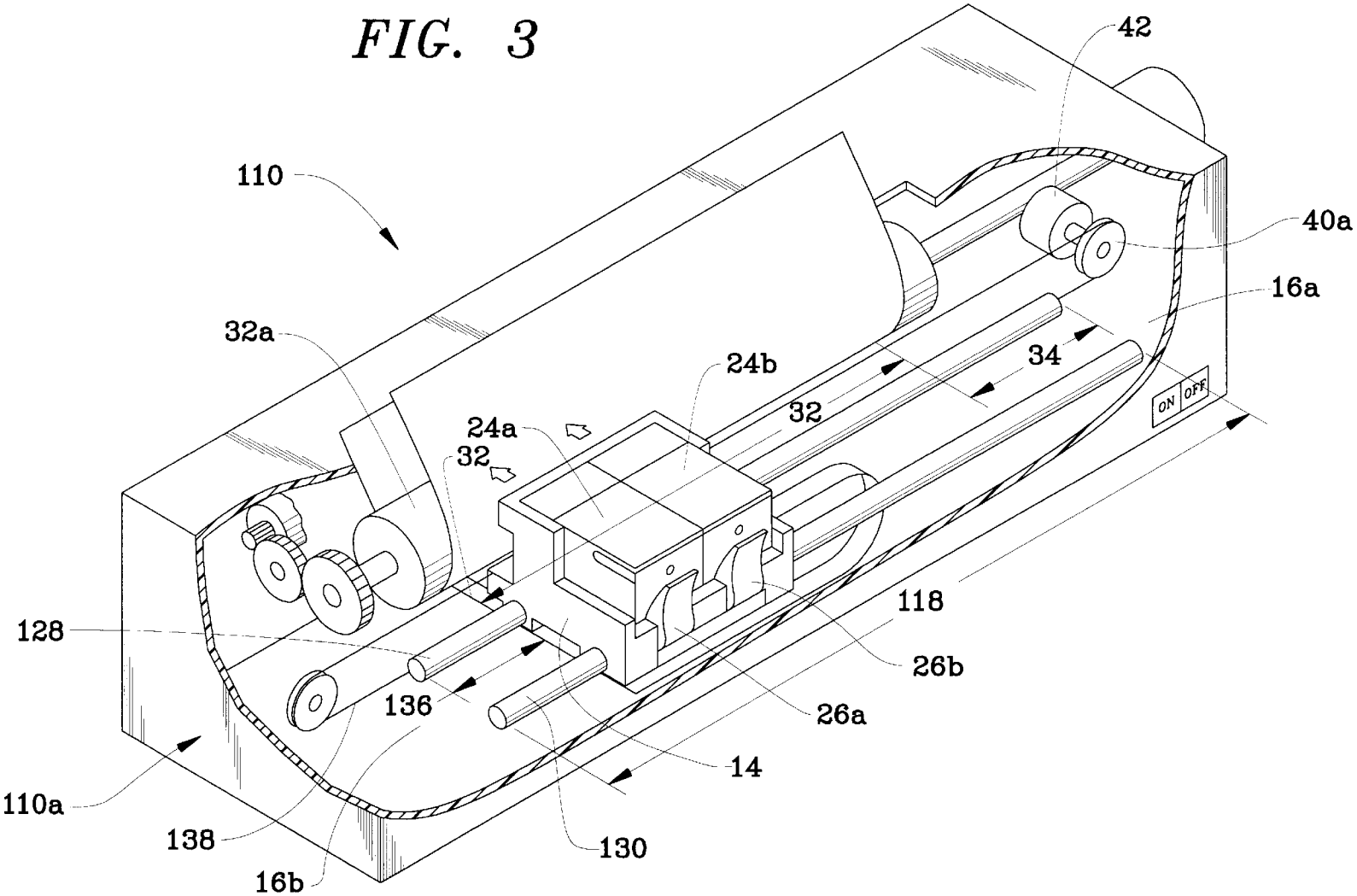
FIG. 3 is a perspective view showing the construction of the area around the print element of an ink jet printing system incorporating the present invention.

The present invention is incorporated in printer 110 depicted in FIG 3. Printer 110 is similar in basic design and operation to printer 10 of FIG. 1. Accordingly, only elements that represent differences are described herein. It is noteworthy that field 118 (from 16A to 16B) is relatively shorter (than field 18), containing therein shorter acceleration ramp area subportion 136. Subportion 136 is shorter than equally-sized subportions 34 and 36 of printer 10, and shorter than subportion 34 of printer 110, which for purposes of this illustration, is the same size as subportions 34 and 36 of printer 10.

In connection with the sizing of subportion 136, shafts 128 and 130, belt 138, and overall housing 110A of printer 110 also are made relatively short in comparison with their printer 10 counterparts, reducing the cost of printer 110 in comparison with printer 10.

Drive apparatus 40 of printer 110 similarly has the capability to accelerate carrier 14 through ramp area subportions 34 and 136 of field 118 for bi-directional printing. However, printer 110 performs letter mode printing uni-directionally and performs only draft mode printing bi-directionally.

Figure 4:
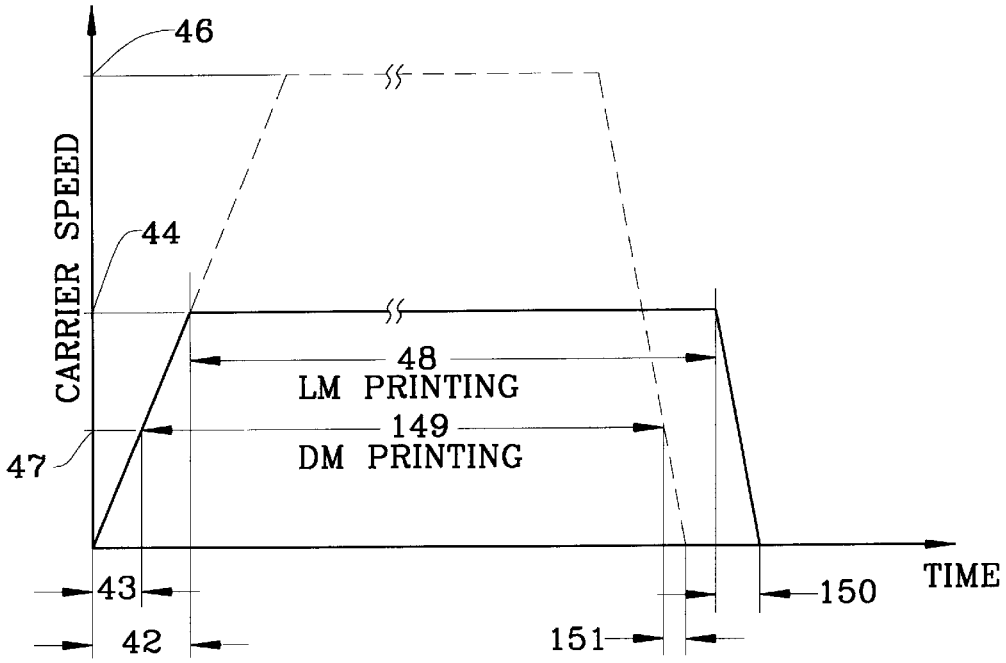
FIG. 4 is a diagrammatic illustration of the operation of the print element in the carrier displacement field for a printer incorporating the present invention.

Referring to FIG. 4, acceleration of carrier 14 to full letter mode speed 44 (e.g., 15 i.p.s. (or any speed between, for example, 13 and 40 i.p.s.)) also takes place over time 42, corresponding to travel of carrier 14 through subportion 34 having an associated length of, for example, 0.30 inches (or between 0.22 and 2.10 inches), and an exemplary rate of acceleration of approximately 1.0 g. Thereafter, carrier 14 travels through print line 32 (having an exemplary length of 8.0 inches) at speed 44 and then decelerates rapidly with, e.g., frictional aid (to rest) over a reduced time 150, corresponding to travel through shortened subportion 136. Subportion 136, which may be for example 0.09 inches, is sufficiently long for letter mode deceleration.

Since letter mode printing is uni-directional, carrier 14 is returned to ramp area subportion 34 through print line portion 32 without printing (preferably at an above-letter mode speed, e.g., the draft mode speed). Thus, the relative shortness of subportion 136 does not undermine printing performance. Moreover, as a consequence of shortened subportion length, carrier return is made even faster, increasing printer system throughput. The shortness also increases stiffness of the printer's mechanisms, improving print quality.

Printer 110 performs draft mode printing bi-directionally. It already has been shown that time of travel 43 of carrier 14 is sufficient to support draft mode acceleration at, for example 1.0 g., with the length of associated subportion 34 being, for example, 0.30 inches and having an intended speed 46, which may be 33 i.p.s. Under such conditions, carrier 14 enters print line 32 at a suitable speed (e.g. speed 47, which is at or above 8.25 i.p.s), while carrier acceleration continues, allowing carrier 14 to attain speed 46 during its travel through print line 32 (over print line time 149) and before the carrier's deceleration upon approaching and through (during time 151) subportion 136. In FIG. 4, deceleration is shown as taking place at a rate equivalent to that of letter mode. However, draft mode deceleration, preferable, may be at the same rate of draft mode acceleration since printing occurs during deceleration anyway.

Even with subportion 136 having a reduced length of, for example, 0.09 inches, draft mode acceleration (or deceleration) of carrier 14 at, for example, 1.0 g causes carrier 14 to attain (or maintain) a speed of at least 8.25 i.p.s. or 25% of the full draft mode speed of 33 i.p.s., which has been found to be acceptable. Of course, specific dimensions of subportion 136 and draft mode speeds may be adjusted in accordance with changes in, among other things, changes in letter mode speeds. For example, adjustments of the length of subportion 156 between 0.07 inches and 0.4 inches are acceptable as are draft mode speed changes between 28 and 70 i.p.s. as long as such changes are made in concert with other parameter settings for printer 110. Thus, reduction of the second (bi-directional) subportion 136 of the present invention allows reduction in the size and cost of the machine without unacceptable impact upon print quality. As seen in this illustrative example, a size reduction of about one-quarter inch is possible over earlier conventional systems. Return time also is reduced in draft mode due to the reduced length of subportion 136. Moreover, as the speed for implementing letter mode printing increases, the length reduction for the acceleration ramp area subportions for draft mode increases proportionally.

Any control apparatus that would be used with such a print system may be used to ensure that draft mode printing that is on-going during acceleration of carrier 14 of printer 110 is effectively achieved.

The present invention also comprises a method incorporating the foregoing teachings. Illustratively, this method is carried out by moving carrier 14 through print line portion 32 of field 18. While so doing, print element 12 (comprising cartridges 24A and 24B with nozzles 22) is used to print images on print or recording media 20. In letter mode, print element 12 of carrier 14 is accelerated uni-directionally through longer acceleration ramp area subportion 34 to first speed 44 associated with letter mode printing for travel through print line portion 32. In draft mode, print element 12 of carrier 14 is accelerated bi-directionally through acceleration ramp area subportion 34 and shorter acceleration ramp are subportion 136 to substantially less than all of a second speed 46 associated with draft mode printing, at which speed draft mode printing commences. Similarly, this method results in size and cost reductions in the use of ink jet printer 110.

The present invention has been particularly shown and described with reference to a preferred embodiment, and with many statements indicating exemplary context. Thus, it should be understood by those skilled in the art that various changes in form and detail may be made without departing from the spirit and scope of the invention and all its incorporated teachings. The teachings here presented specifically are intended to cover any variations, uses, or adaptions of the invention using its general principles. Further, it covers known or customary practice in the art to which this invention pertains and which fall within the appended claims.

What is claimed is:

1. A printing system comprising a carrier displacement field and a carrier for moving a print element through a predetermined fixed length print line portion of the carrier displacement field to place print images on recording media, wherein the displacement field comprises a first acceleration ramp area subportion and a second acceleration ramp area subportion, the subportions being located on opposite sides of the print line portion and being of differing predetermined fixed lengths, the lengths of the print line portion and the respective first and second acceleration ramp areas being independent of the length of the print data to be printed in the print line portion, with the first acceleration ramp area subportion being relatively longer and permitting acceleration of the carrier to a first print element carrier speed, and the second acceleration ramp area subportion being relatively shorter and permitting acceleration of the carrier to substantially less than all of a second print element carrier speed.

2. The printing system of claim 1, wherein the carrier, traveling at the first print element carrier speed, is operable to place print images only when accelerated from the first acceleration ramp area subportion, and wherein the carrier accelerated to the second print element carrier speed, is operable to place print images when accelerated from the first or the second acceleration ramp area subportion.

3. The printing system of claim 2, wherein the first print element carrier speed is lower than the second print element carrier speed to support a higher print quality at the first print element carrier speed.

4. The printing system of claim 3, wherein the first print speed is approximately one half of the second print element carrier speed.

5. The printing system of claim 4, wherein the second acceleration ramp area is sized to permit acceleration of the print element to no less than approximately 25% of the second print element carrier speed.

6. The printing system of claim 3, wherein the first print element carrier speed is between 13 and 40 inches per second and the second print element carrier speed is between 28 and 70 inches per second.

7. The printing system of claim 6, wherein the print system further includes means for accelerating the carrier through the first and second acceleration ramp area subportions at approximately 1 g.

8. The printing system of claim 7, wherein the first acceleration ramp area subportion is between 0.22 and 2.1 inches in length and the second acceleration ramp area subportion is between 0.07 and 0.4 inches in length.

9. The printing system of claim 1, wherein the print element comprises a thermal-ink jet print cartridge.

10. A method for control of a printing system, comprising a carrier displacement field and a carrier for moving a print element through a print line portion of the carrier displacement field to print images on recording media, comprising the steps of:

accelerating the carrier in a first direction toward the print line portion of the carrier displacement field through a first relatively longer acceleration ramp area subportion of the carrier displacement field to a first print element carrier speed and moving the carrier at a substantially constant speed through substantially the entirety of the print line portion for un-idirectional travel through the print line portion at the first print element carrier speed in a first print mode;

accelerating the carrier in the first direction toward the print line portion through the first relatively longer acceleration ramp area subportion and in a second direction toward the print line portion through a second relatively shorter acceleration ramp area subportion to substantially less than all of a second print element carrier speed and continuing acceleration of the carrier to the second print element carrier speed in the second direction through a substantial length of the print line portion for bi-directional travel of the carrier in a second print mode; and printing images on the recording media using the print element during travel of the print element through the print line portion.

11. The method of claim 10, wherein the step of accelerating the carrier further includes continuing to accelerate the print element to the second print element carrier speed within the print line portion.

12. The method of claim 11, wherein the steps of accelerating the carrier in the first and second acceleration ramp area subportions further include accelerating the carrier through the subportions at a constant, essentially identical rate in the first and second modes.

13. The method of claim 11, wherein the steps of accelerating the carrier to substantially all of the second print element carrier speed, further includes accelerating to a second print element carrier speed that is approximately twice the first print element carrier speed.

14. The method of claim 13, wherein the steps of accelerating to the first and second print element carrier speeds in the first and second modes, respectively, and printing further include printing in a relatively higher quality mode in the first mode and a relatively lower quality mode in the second mode.

15. The method of claim 13, wherein the steps of accelerating the carrier to the first and second print element carrier speeds include accelerating the print element to between 13 and 40 inches per second and between 28 and 70 inches per second, respectively.

16. The method of claim 15, wherein the steps of accelerating the carrier to the first and second print element speeds include accelerating the carrier at approximately 1 g. to achieve both print element carrier speeds.

17. The method of claim 16, wherein the step of accelerating the carrier through the first acceleration ramp area subportion includes accelerating the print element through a distance of between 0.22 and 2.1 inches, and the step of accelerating the carrier through the second acceleration ramp area subportion includes accelerating the print element through a distance of between 0.07 and 0.4 inches.

18. The method of claim 13, wherein the step of accelerating the carrier through the second acceleration ramp area subportion includes accelerating the carrier therein to no less than approximately 25% of the second print element carrier speed.

19. The method of claim 10, further providing the step of providing a thermal-ink jet print element and wherein the step of printing images on recording media includes using the thermal-ink jet print element.

20. A method of controlling a print element carrier of a printing system along a carrier displacement field having a print line portion interposed between first and second acceleration portions of fixed non-variable lengths, comprising the steps of:

(a) accelerating displacement the carrier in a first direction along the first acceleration ramp for a first predetermined non-variable distance to a first fixed location in the carrier field without placing print images on a recording media;

(b) moving the carrier in the first predetermined direction from the first fixed location along the print line portion of the carrier displacement field at a substantially constant velocity to a second fixed location in the carrier field with the carrier being operative to selectively placing print images on a recording media during the movement from the first to the second fixed locations, the second fixed location being a predetermined non-variable distance from the first fixed location;

(c) decelerating displacement of the carrier to zero velocity from the second fixed location along the second acceleration portion of the carrier displacement field without placing print images on a recording media from the second fixed location to a third fixed location that is displaced from the second fixed location by a second predetermined non-variable distance less than the first predetermined distance;

(d) accelerating the carrier in a second direction opposite to the first predetermined direction along the second acceleration portion of the carrier displacement field from the third fixed location to the second fixed location without placing print images on a recording media; and (e) continuing acceleration of the carrier in the second direction along the print line portion of the carrier displacement field from the second location to a fourth location intermediate the first and second locations with the carrier being operative to selectively placing images on a recording media during movement from the third to the fourth locations.

* * * * *